US007204717B2

(12) United States Patent
Chang et al.

(10) Patent No.: US 7,204,717 B2
(45) Date of Patent: Apr. 17, 2007

(54) CARD CONNECTOR

(75) Inventors: Wei-Cheng Chang, Tu-Cheng (TW); Hsueh Lung Hsiao, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/218,754

(22) Filed: Sep. 2, 2005

(65) Prior Publication Data

US 2006/0223375 A1 Oct. 5, 2006

(30) Foreign Application Priority Data

Apr. 1, 2005 (TW) ..... 94205116 U

(51) Int. Cl.
*H01R 24/00* (2006.01)

(52) U.S. Cl. ..... 439/630; 439/736

(58) Field of Classification Search ..... 439/630, 439/736, 607

See application file for complete search history.

(56) References Cited

U.S. PATENT DOCUMENTS 4,900,272 A * 2/1990 Lange et al. ..... 439/630
5,746,607 A * 5/1998 Bricaud et al. ..... 439/66
5,800,200 A * 9/1998 Brioaud et al. ..... 439/404
5,980,323 A * 11/1999 Bricaud et al. ..... 439/630
6,695,647 B2 * 2/2004 Tsai ..... 439/630
6,863,570 B2 * 3/2005 Chen ..... 439/630
2001/0049231 A1 * 12/2001 Bricaud ..... 439/630
2002/0042230 A1 * 4/2002 Bricaud et al. ..... 439/630
2003/0073351 A1 * 4/2003 Fukumoto et al. ..... 439/630
2003/0203678 A1 * 10/2003 Farnworth et al. ..... 439/630
2005/0142948 A1 * 6/2005 Lee ..... 439/630

* cited by examiner

*Primary Examiner*—Gary F. Paumen
(74) *Attorney, Agent, or Firm*—Wei Te Chung

(57) ABSTRACT

A card connector includes an insulating housing (1), a number of contacts (4) and a holding plate (8', 8). The insulating housing (1) defines a card receiving space (130) with a card inserting opening along a card inserting direction. The contacts (4) include bended contacting portions cantilevered exposed in the card receiving space (130) and soldering portions retained on the insulating housing. The holding plate (8', 8) is assembled to the insulating housing and formed with a receiving portion, free ends of the contacting portions of the contacts (4) are received in the receiving portion of the holding plate to avoid colliding with a card directly.

17 Claims, 6 Drawing Sheets

CARD CONNECTOR

BACKGROUND OF THE INVENTION

1. Field of the Invention

The present invention relates to a card connector, especially to a card connector which can accept more different cards.

2. Description of Related Art

A conventional card connector comprises an insulting housing defining a card receiving space and a plurality of contacts made of metal leaf spring received in the housing. The contacts have bended contacting portions exposed and resiliently cantilevered in the card receiving space. When a card is inserted into the card receiving space, the card will electrically connect with the contacting portions of the contacts. However, because the contacting portions are freely and elastically cantilevered in the card receiving space and no additional appliance to hold the contacting portions of the contacts, the card will probably collide with free ends of the contacting portions when the card is inserted into the card receiving space. The contacts may be distorted or destroyed by the collision between the contacts and the card, and thus, preventing the card from inserting further. Therefore, the signal transmission between the card and contacts is effected.

Hence, an improved card connector is required to overcome the problems of the prior art.

SUMMARY OF THE INVENTION

An object of the present invention is to provide a card connector which can achieve more reliable signal transmission effect.

Another object of the present invention is to provide a card connector which has well-protected electrical contacts.

Accordingly, to achieve above-mentioned object, a card connector comprises an insulating housing, a plurality of contacts and a holding plate. The insulating housing defines a card receiving space with a card inserting opening along a card inserting direction. The plurality of contacts comprises bended contacting portions cantilevered exposed in the card receiving space and soldering portions retained on the insulating housing. The holding plate is assembled to the insulating housing and formed with a receiving portion, free ends of the contacting portions of the first contacts are received in the receiving portion of the holding plate to avoid colliding with a card directly.

The detailed features of the present invention will be apparent in the detailed description with appropriate reference to the accompanying drawings.

DETAILED DESCRIPTION OF THE INVENTION

Figure 1:
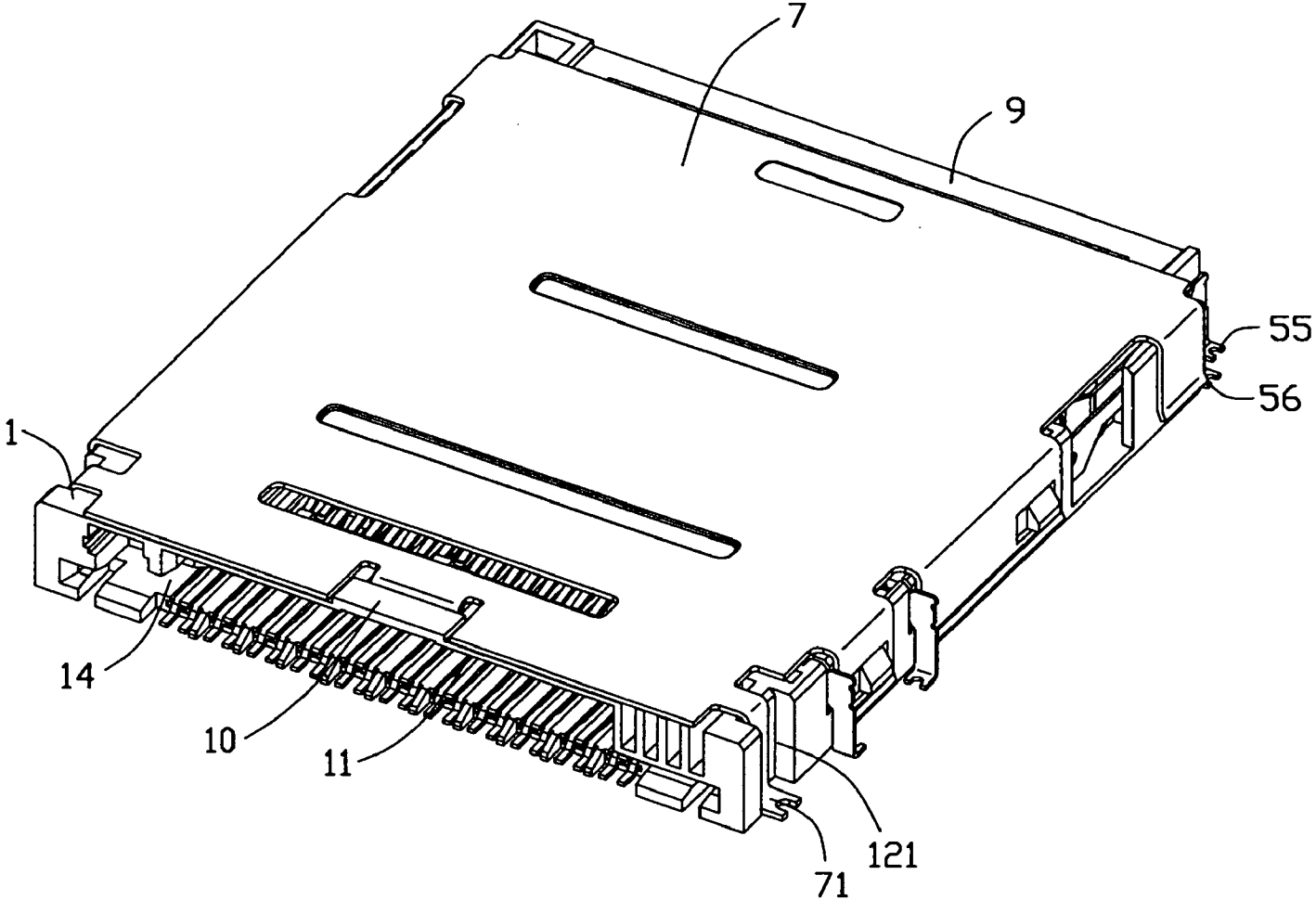
FIG. 1 is an assembled, perspective view of a card connector in accordance with a preferred embodiment of the present invention.

Reference will now be made in detail to a preferred embodiment of the present invention.

Referring to FIGS. 1 to 6, a card connector in accordance with the present invention is adapted for insertion of different kinds of cards. The card connector comprises an insulating housing 1, a plurality of sets of contacts including a first set of contacts 4, a second set of contacts 2, a third set of contacts 3, and a fourth set of contacts 5 for electrically connecting with corresponding different cards, such as an XD card, an MS card, an SD/MMC card and an SM card, a defend mechanism 6, a conductive shell 7 and a first and second holding plates 8', 8 assembled to the housing 1 and with the first set of contacts 4 and the second set of contacts 2 arranged therein, respectively.

The insulating housing 1 is approximately box-liked and comprises a top wall 10, a pair of opposite sidewalls 12, 13, a bottom wall 14 and a rear wall 15, which commonly define a card receiving space 130. The insulating housing 1 further defines a card inserting opening 11 recessed inwardly from a front face thereof to communicate with the card receiving space 130. The top wall 10 is formed with an opening 100 communicating with the card receiving space 130 and located behind the card inserting opening 11 along a card inserting direction, and a cut 101 thereon adjacent to the card inserting opening 11.

The shell 7 is disposed on the top wall 10 of the insulating housing 1 in virtue of forming with a holding piece 73 at front end thereof to lock in the cut 101 of the housing 1 and a pair of holding pieces 71 to hold in a pair of gaps 121 formed on front ends of the opposite sidewalls 12, 13 of the housing 1 (referring to FIG. 1). The defend mechanism 6 is disposed in the housing 1 and partially protrudes into the card receiving space 130 for preventing cards from mismating.

The first holding plate 8' and the second holding plate 8 are approximately plate configuration. The first holding plate 8' is disposed on a rear part of the opening 100 of the top wall 10 of the housing 1 adjacent to the rear wall 15 thereof to face the card receiving space 130, and defines a pair of holes 81' on rear portion thereof. The second holding plate 8 is also disposed above the opening 100 of the top wall 10 in virtue of a block 80 and a column 84 formed thereof to be received in the housing 1. The second holding plate 8 is formed with a pair of column portions 85 at rear end thereof and assembled to the first holding plate 8' with the column portions 85 mating with the holes 81' of the first holding plate 8'. The second holding plate 8 is further formed with a plurality of notches 83 formed at a lower face adjacent to a front portion thereof along a transverse direction perpendicular to a card inserting direction and a plurality of protrusions 81 extending downward and rearward from front sides of the corresponding notches 83. Thus, the protrusions 81 partially cover the notches 83. In addition, the protrusions 81 are formed with slanting portions 82 towards the card insertion opening 11 for guiding insertion of a card, such as an XD card.

Referring to FIGS. 2 to 5, The first set of contacts 4 are made of metal leaf spring and arranged in the first holding plate 8'. Each contact 4 comprises a bended contacting portion 41 cantilevered exposed in the card receiving space 130 and a soldering portion 42 extending rearward from the contacting portion 41 and exposed outside the rear wall 15. The soldering portions 42 are divided into two groups to leave a space (not labeled) therebetween and a transverse bar (not labeled) connects the contacting portions 41. In addition, the first set of contacts 4 further comprise a sensor switch 43 disposed at a distal end thereof with a contacting portion 41 differed from those of other contacts 4. A grounding contact 44 and a protecting contact 45 are further included in the first set of contacts 4 and respectively disposed in the sidewall 12.

Figure 3:
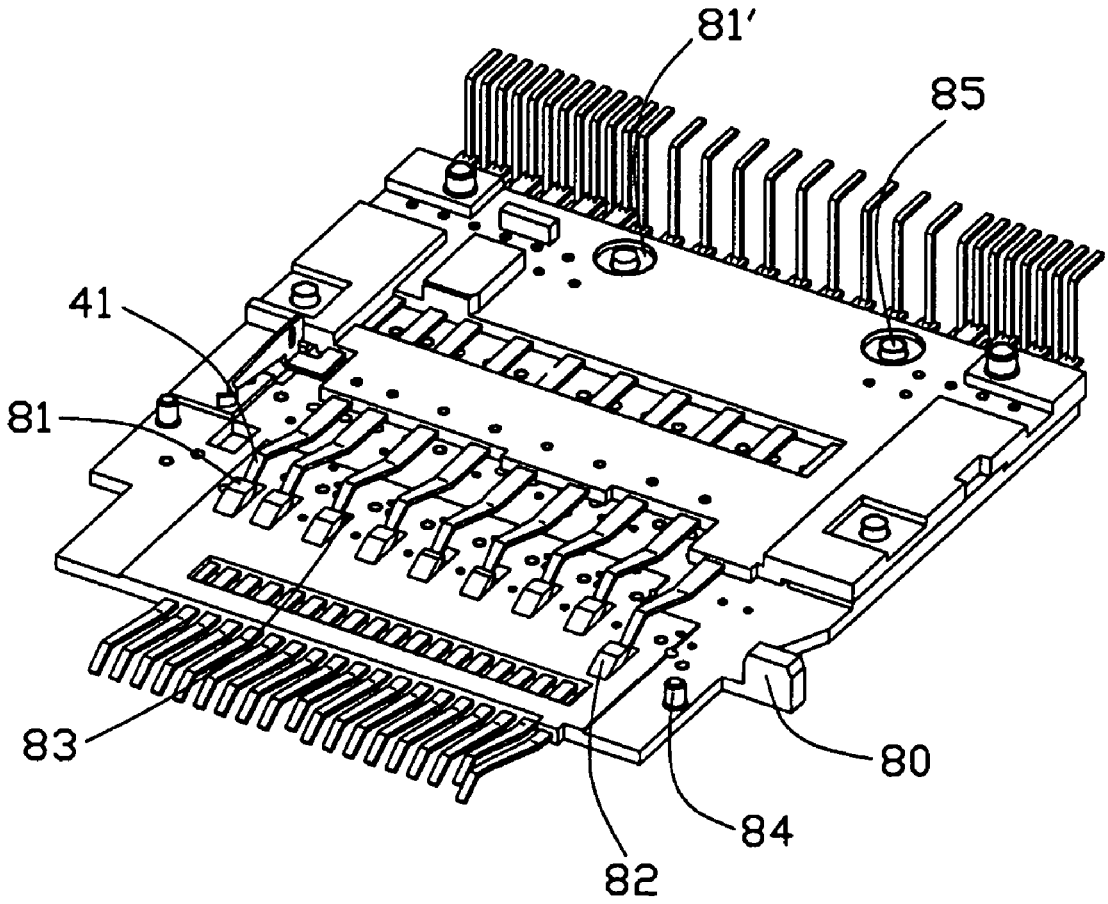
FIG. 3 is a partially assembled, perspective view of the card connector shown in FIG. 2 and viewed from another aspect.

Referring to FIG. 3, when the first holding plate 8' and the second holding plate 8 are assembled together, free ends of the bended contacting portions 41 are received in a space defined between the notches 83 and the protrusions 81. Namely, the free ends of the contacting portions 41 are located behind the protrusions 81 and hide in the space between the notches 83 and the protrusions 81 to avoid colliding with the corresponding card directly. Thus, because of existences of the protrusions 81 and notches 83, when a card, such as an XD card, is inserted into the card receiving space 130, the card will not collide with the free ends of the contacting portions 41 directly but safely connected with the contacting portions 41. The protrusions 81 and the notches 83 are served as receiving portions to shield the free ends of the contacting portions 41.

Referring to FIGS. 1, 4, 5 and 6, the second set of contacts 2 are arranged in the second holding plate 8 and each comprises a contacting portion 21 exposed in the card receiving space 130 adjacent to the card inserting opening 11 and a soldering portion 22 extending from the contacting portion 21 to expose outside the rear wall 15 of the housing 1. Front portion of the top wall 10 along the card inserting direction is formed with a plurality of protruding portions 161, 162 and 163 protruding towards the opening 100 along the transverse direction. Free ends of the contacting portions 21 of the contacts 2 abut against upper faces of the protruding portions 161, 162 and 163 exposed outside of the card receiving space 130. Thus, when a card, such as an MS card, is inserted into the card receiving space 130, the card will not collide with the free ends of the contacting portions 21 and safely connect with the contacting portions 21 of the contacts 2.

Figure 2:
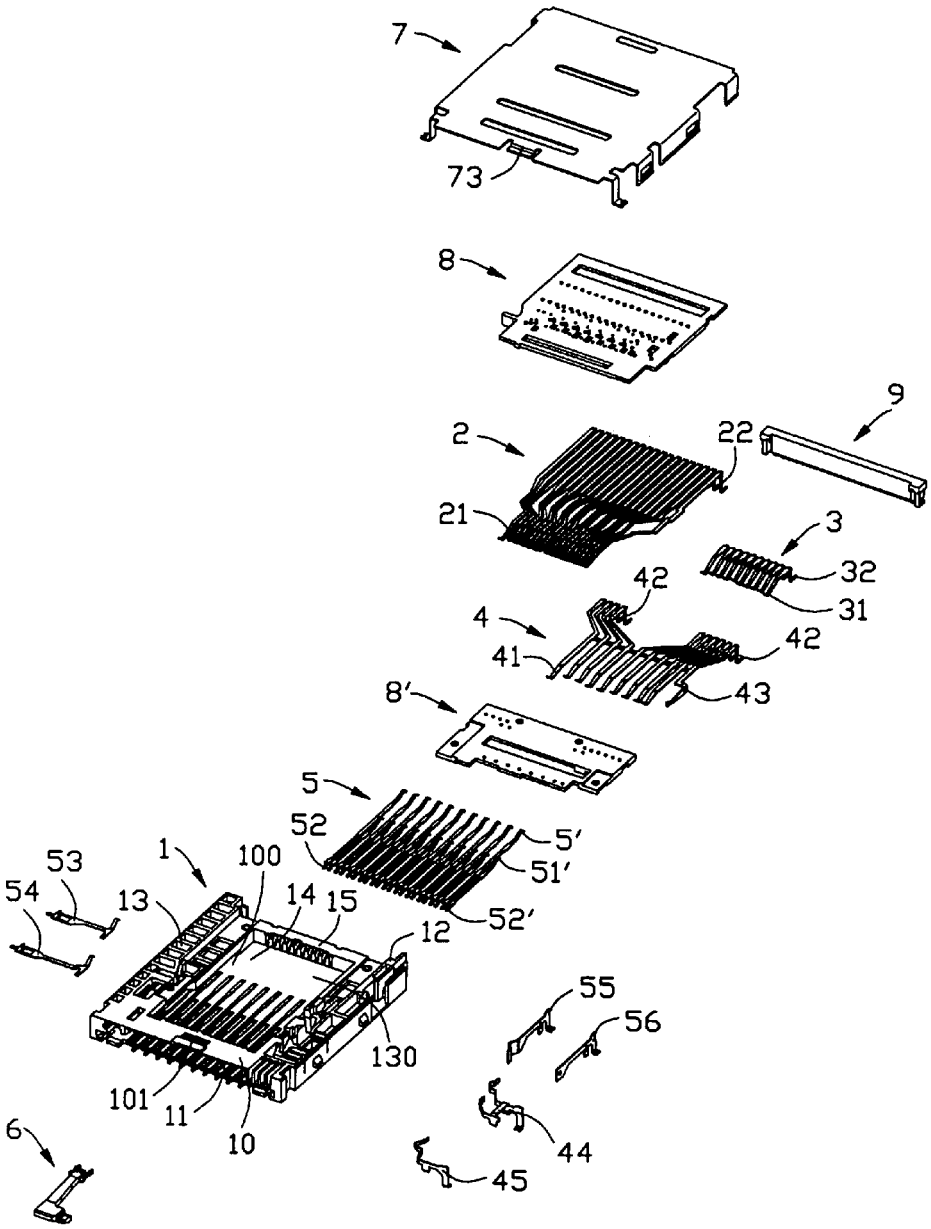
FIG. 2 is an exploded, perspective view of the card connector shown in FIG. 1.
Figure 5:
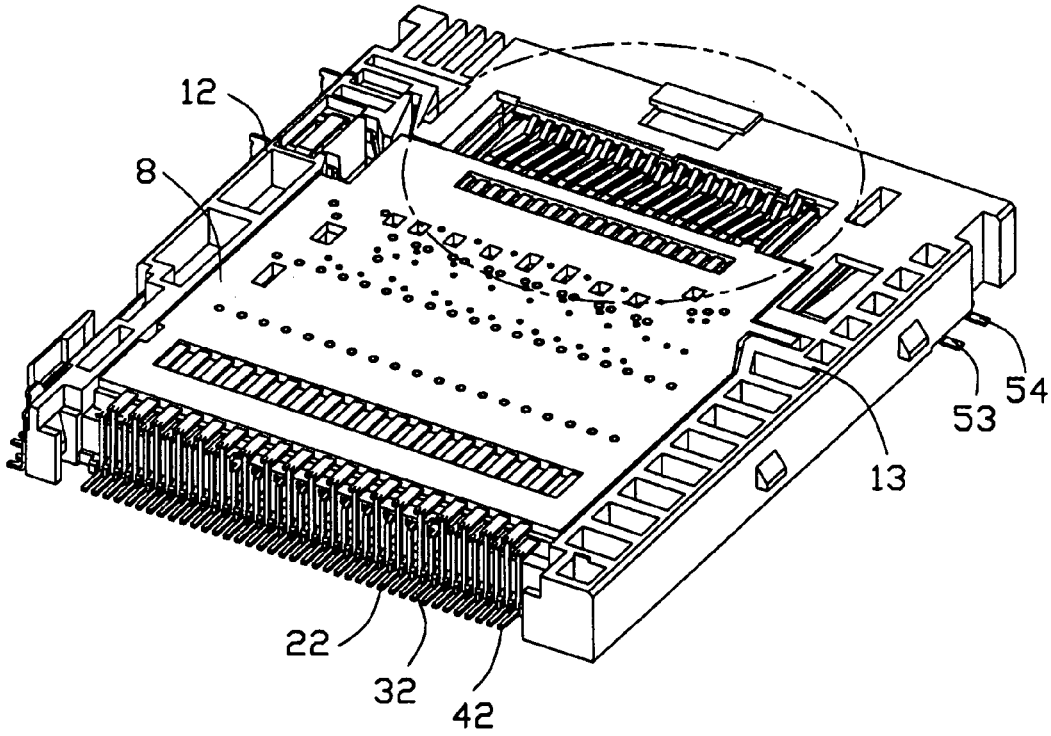
FIG. 5 is an assembled, perspective view of the card connector shown in FIG. 4.
Figure 6:
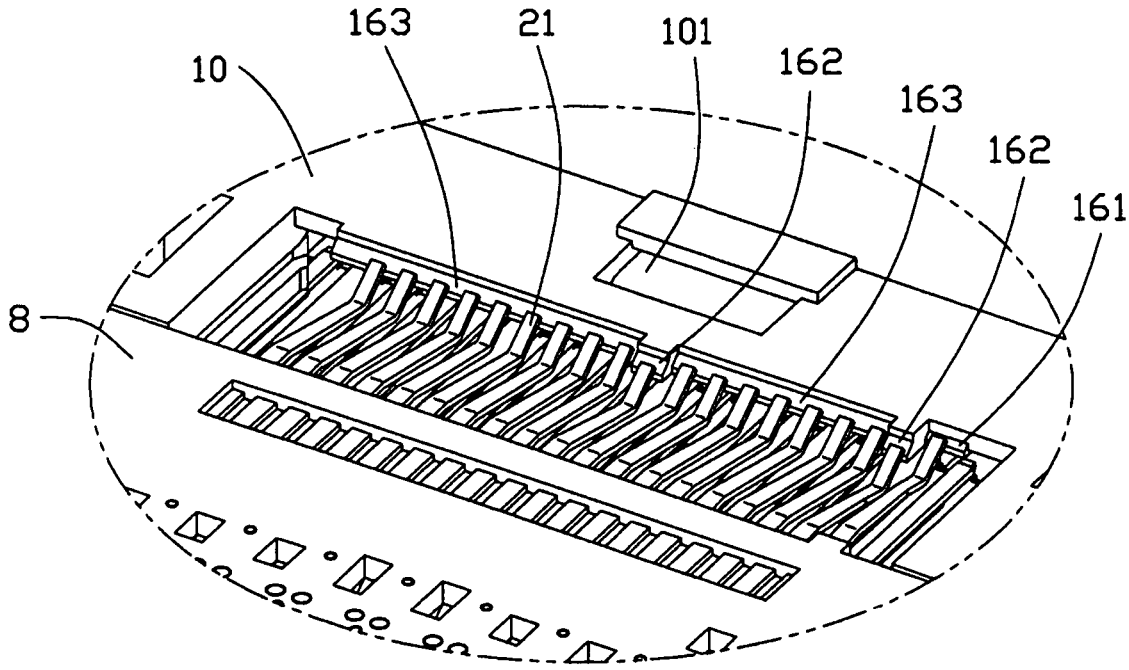
FIG. 6 is an enlarged perspective view of the area circled in FIG. 5.

Referring to FIGS. 2 and 5, the third set of contacts 3 are disposed in contacting channels (not labeled) formed in the rear wall 15 of the housing 1. Each contact 3 comprises a contacting portion 31 exposed in the card receiving space 130 and a soldering portion 32 extending rearward from the contacting portion 31 through the rear wall 15 to expose outside the housing 1.

Figure 4:
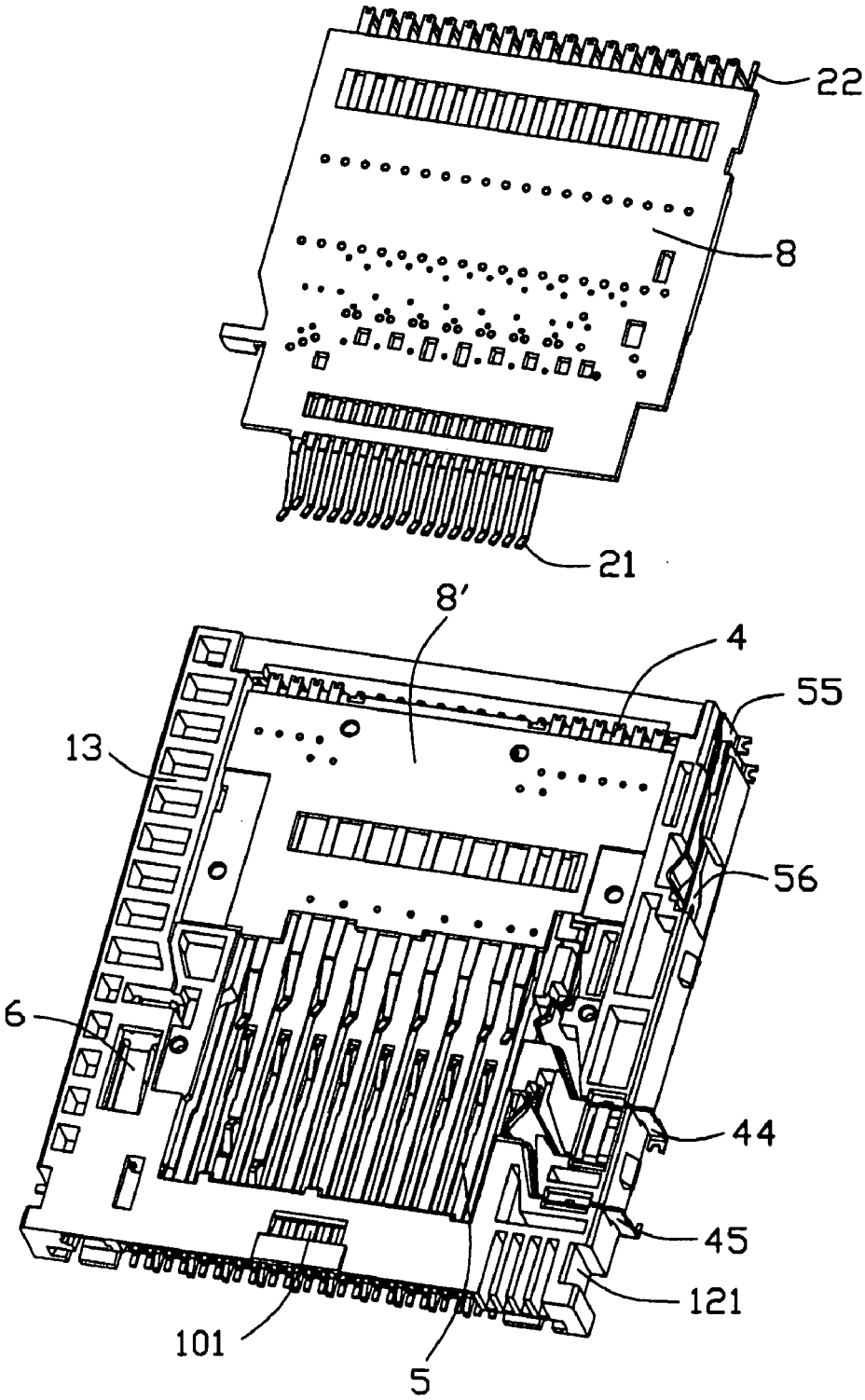
FIG. 4 is a partially exploded, perspective view of the card connector shown in FIG. 1.

Referring to FIGS. 2 and 4, the fourth set of contacts 5 are disposed on the bottom wall 14 and comprise two rows of contacting members with different lengths and arranged alternately. The contacting members comprise contacting portions 51, 51' exposed in the card receiving space 130 and soldering portions 52, 52' extending forwardly from the contacting portions 51, 51' to expose outside the front face of the housing 1. The length of the contacting portions 51 is longer than that of the contacting portion 51'. Longitudinally extending sensor contact 55 and grounding contact 56 are disposed in the sidewall 12 of the housing 1 adjacent to the rear wall 15 and transversely extending read/written contacts 53, 54 are disposed in the sidewall 13 of the housing 1 adjacent to the card inserting opening 11.

Referring to FIGS. 1 and 2, a holding member 9 is assembled to the rear wall 15 of the housing 1 to hold the soldering portions 22, 32 and 42 of the corresponding card contacts 2, 3 and 4.

While a preferred embodiment in accordance with the present invention has been shown and described, equivalent modifications and changes known to persons skilled in the art according to the spirit of the present invention are considered within the scope of the present invention as described in the appended claims.

What is claimed is:

1. A card connector, comprising:

an insulating housing defining a card receiving space with a card inserting opening along a card inserting direction; and a holding plate having a plurality of receiving portion immoveable relative to the housing and having a first set of contacts fully circumferentially embedded therein via an insert molding procedure, free ends of the contacting portions of the first contacts being received in the receiving portion of the holding plate to avoid colliding with a card directly.

2. The card connector as described in claim 1, wherein the holding plate comprises a first holding plate and a second holding plate assembled with the first holding plate.

3. The card connector as described in claim 2, wherein the first holding plate and the second holding plate are approximately plate configuration.

4. The card connector as described in claim 2, wherein the contacts comprise a first set of contacts arranged in the first holding plate.

5. The card connector as described in claim 4, wherein the receiving portion is formed on the second holding plate, and wherein the free ends of the contacting portions of the first set of contacts are received in the receiving portion.

6. The card connector as described in claim 4, wherein the contacts further comprises a second set of contacts arranged in the second holding plate and the second contacts comprise contacting portions exposed in the card receiving space.

7. The card connector as described in claim 6, wherein the insulating housing comprises a top wall formed with protruding portions protruding rearward therefrom, free ends of the contacting portions of the second contacts we located above the protruding portions to be exposed outside of the card receiving space.

8. The card connector as described in claim 1, wherein the receiving portion comprises notches and protrusions protruding rearward from front sides of the corresponding notches.

9. The card connector as described in claim 8, wherein the free ends of the contacting portions of the first contacts are located between the protrusions and the notches.

10. The card connector as described in claim 8, wherein the protrusions are formed with slanting portions along the card inserting direction to guiding insertion of a corresponding card.

11. The card connector as described in claim 1, further comprising a conductive shell covering the insulating housing.

12. A card connector comprising:

an insulative housing defining a card receiving space therein;

a first contact module having a first insulative structure immoveable relative to the housing and having a first set of contacts embedded therein via an insert molding procedure, free ends of the first set of contacts being free from said first contact module without restriction;

a plurality of protrusions being immoveable relative to the housing and located around the free ends of the first set of contacts for protecting said free ends from collision; wherein said protrusions are not integrally formed with said first insulative structure, said connector further including a second contact module having a second insulative structure wit a second set of contacts embedded therein, wherein said protrusions are integrally formed on said second contact module.

13. The card connector as claimed in claim 12, wherein said first insulative structure and said second insulative structure are fastened together.

14. The card connector as claimed in claim 13, wherein contacting portions of the first set of contacts and those of the second set are located at different positions in a front-to-back direction.

15. The card connector as claimed in claim 14, wherein soldering portions of the first set of contacts and those of the second set are located on a same side of the housing.

16. A card connector comprising:

an insulative housing defining a card receiving space therein;

a first contact module having a first insulative structure immoveable relative to the housing and having a first set of contacts embedded therein via an insert molding procedure, free ends of the first set of contacts being free from said first contact module without restriction;

a plurality of receiving openings being formed within a second insulative structure which is immoveable relative to the housing and the first insulative structure, said receiving openings receiving the free ends of the first set of contacts for protecting said free ends from collision; wherein said second insulative structure is not integrally formed with said first insulative structure;

wherein the second insulative structure is provided by a second contact module.

17. The card connector as claimed 16 wherein said first insulative structure and said second insulative structure are fastened together.

* * * * *